United States Patent [19]

Hellman et al.

[11] Patent Number: 4,780,139

[45] Date of Patent: Oct. 25, 1988

[54] TOOL STEEL

[75] Inventors: Per I. Hellman, Osterby; Henry L. Wisell, Södertors, both of Sweden

[73] Assignee: Kloster Speedsteel AB, Sweden

[21] Appl. No.: 819,542

[22] Filed: Jan. 16, 1986

[30] Foreign Application Priority Data

Jan. 16, 1985 [SE] Sweden ..... 8500185

[51] Int. Cl.[4] ..... C22C 29/06

[52] U.S. Cl. ..... 75/240; 75/241

[58] Field of Search ..... 75/238, 239, 240, 241, 75/246, 242; 420/12, 15, 42, 69, 87, 101, 102, 105, 107, 111, 114, 122, 124, 127, 128

[56] References Cited

U.S. PATENT DOCUMENTS

| | | | |
|---|---|---|---|
| 1,727,282 | 9/1929 | Gill | 420/114 |
| 1,775,615 | 9/1930 | Succop | 420/111 |
| 1,778,226 | 10/1930 | Nelson | 420/114 |
| 1,998,957 | 4/1935 | Emmons | 420/102 |
| 2,105,114 | 1/1938 | Gill | 420/111 |
| 2,147,122 | 2/1939 | Emmons | 420/102 |
| 3,012,879 | 12/1961 | Schempp et al. | 420/111 |
| 3,163,525 | 12/1964 | Fletcher et al. | 420/111 |
| 3,219,442 | 11/1965 | Johnstin | 420/101 |
| 3,627,514 | 12/1971 | Steven | 420/102 |
| 3,809,541 | 5/1974 | Steven | 75/246 |
| 3,833,360 | 9/1974 | Giflo et al. | 420/124 |
| 3,850,621 | 11/1974 | Haberling et al. | 420/111 |
| 3,993,445 | 11/1976 | Reen | 75/246 |
| 4,035,159 | 7/1977 | Hashimoto et al. | 75/246 |
| 4,150,978 | 4/1979 | Schlatter et al. | 420/69 |
| 4,224,060 | 9/1980 | de Souza et al. | 420/114 |
| 4,469,514 | 9/1984 | Holtz, Jr. | 420/111 |
| 4,519,839 | 5/1985 | Toyoaki et al. | 75/242 |

FOREIGN PATENT DOCUMENTS 1237244 6/1971 United Kingdom .

*Primary Examiner*—Stephen J. Lechert, Jr.
*Assistant Examiner*—Eric Jorgensen
*Attorney, Agent, or Firm*—Kenyon & Kenyon

[57] ABSTRACT

A vanadium-containing power tool steel is disclosed. The steel is compacted to full density at high temperature and presence and contains $M_6C$ or $M_7C_3$ carbides. The carbides have an effective maximal size of 4 to 15 microns.

11 Claims, 2 Drawing Sheets

TOOL STEEL

FIELD OF THE INVENTION

This invention relates to a novel tool steel containing vanadium and made from metal powder by subjecting the powder to compacting at a high pressure and high temperature to full density. The invention particularly relates to a novel high speed steel, but the principles of the invention also can be applied upon cold work steels.

BACKGROUND OF THE INVENTION

High contents of chromium, molybdenum and/or tungsten provide a high tempering resistance to high speed steels which is the fundamental factor for the good properties of these steels when used for cutting tools. The said elements, and particularly molybdenum and tungsten, also contribute to provide a high hardness and good wear resistance to the steel by combining with carbon in the steel to form $M_6C$-carbides. Modern high speed steels also contain high contents of vanadium which on one hand exist dissolved in the matrix and on the other hand form MC-carbides which are harder than the $M_6C$-carbides and therefore have been considered to be desirable with reference to the demand on good wear resistance. In conventional steel production these MC-carbides tend to be comparatively large because of the slow cooling in ingot moulds, These large MC-carbides have a strong detrimental effect upon the grindability of the steel.

In powder metallurgical production of high speed steels, quickly solidified metal powder is subjected to compaction at a high pressure and high temperature to full density. The carbides in the metal powder are originally very small and uniformly distributed in the steel matrix owing to the quick cooling in the powder production. However, because of the high temperature during consolidation, the carbides grow. If this growth exceeds a certain size, the properties of the steel are impaired, in the first place its grindability, so that 3 microns has been considered to be the maximal size of these carbides which can be tolerated. In order to achieve this goal, heating during the consolidation of the powder steel has been performed at a temperature not exceeding approximately 1150° C. in view of the fact that higher temperatures being about a considerably faster carbide growth. This, however, reduces productivity.

Similar problems also arise in the powder metallurgical production of vanadium-containing cold work steels of the type which contain relatively high proportions of chromium and carbon, Besides $M_7C_3$-carbides, these steels (because of the vanadium content) usually will also contain MC-carbides.

DETAILED DESCRIPTION OF THE INVENTION

Figure 1:
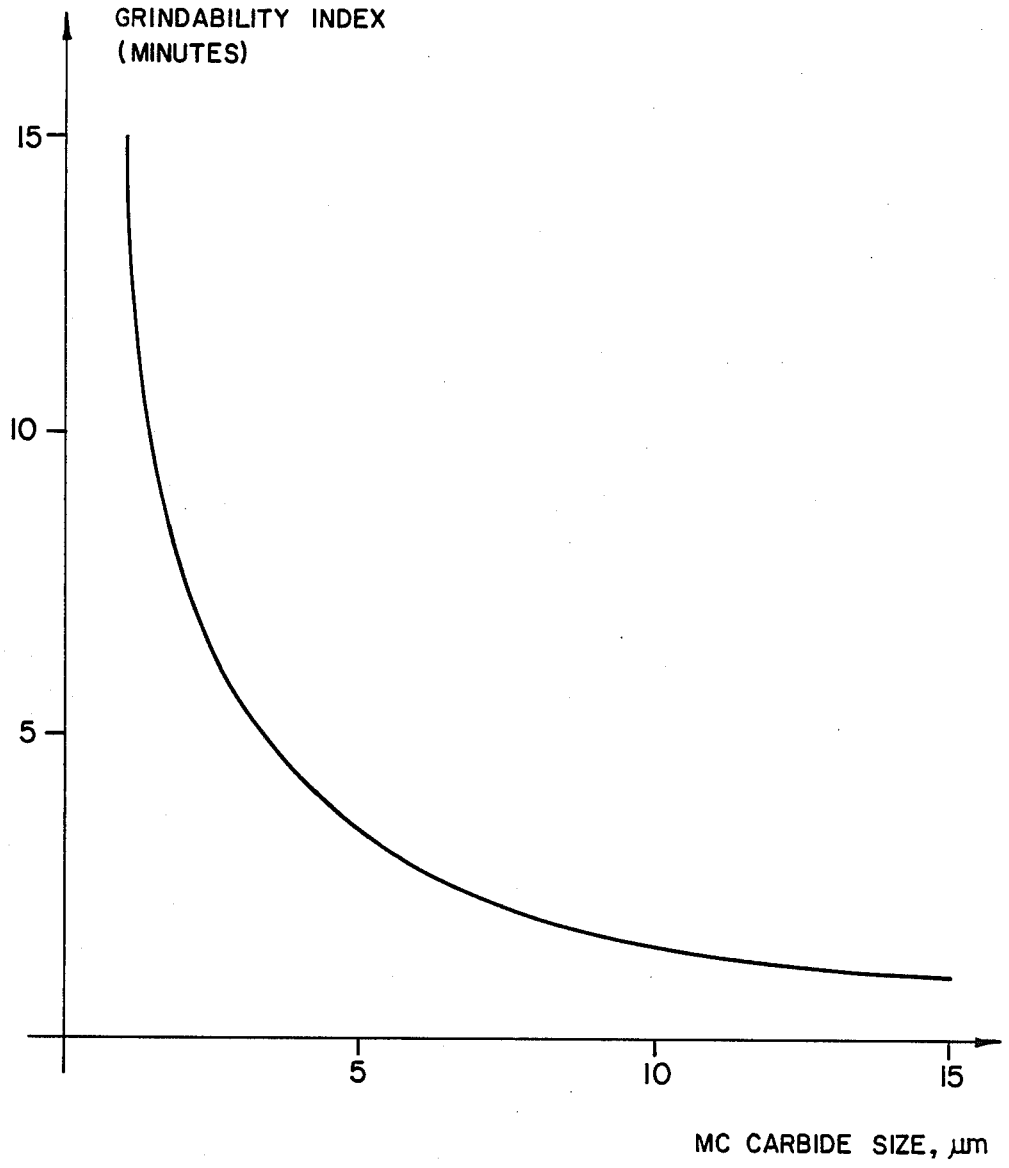
FIG. 1 is a diagram which shows the grindability index of a commercially available powder metallurgically produced high speed steel (ASP 23) as a function of the MC-carbide size.
Figure 2:
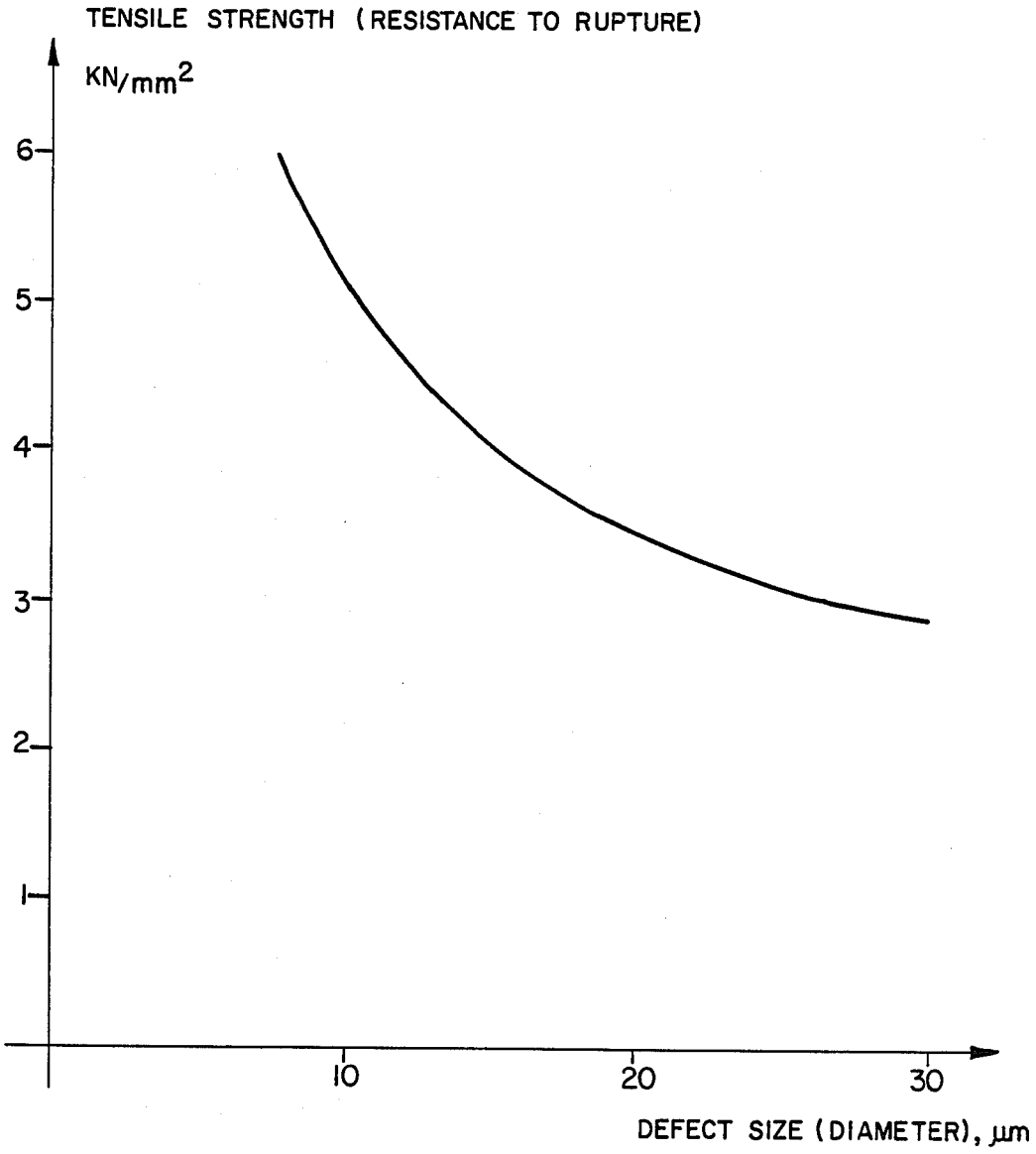
FIG. 2 is a diagram which shows the resistance to rupture of the same steel as a function of defect size.

This invention is based on the discovery that it is only large MC-carbides which have a considerable detrimental effect upon the grindability of high speed steels, while $M_6C$-carbides are much more harmless in this respect. This knowledge as applied to high speed steels is employed according to the invention herein whereby the alloying composition is selected such that no MC-carbides are formed, but instead, more $M_6C$-carbides are formed as compared to what is formed in corresponding high speed steel compositions known in the art. In the first place the vanadium content has been adapted such that essentially all vanadium in the steel exists dissolved in the matrix or mixed with molybdenum and tungsten in the $M_6C$-carbides. During the consolidation of the metal powder to a fully dense body to form the steel of the invention, the powder is subjected to heating at a higher temperature than what has been previously possible for powder steels, such that the hard phase particles, which substantially completely consist of $M_6C$-carbides, to a substantial part have been allowed to grow to sizes which in high grade powder steels known in the art have been unacceptable with reference to the demands as far as grindability is concerned. In the powder metallurgical production of vanadium-containing cold work steel, it is possible, in a corresponding manner, essentially to prevent the formation of MC-carbides in favor of the production of larger $M_7C_3$-carbides.

It is also known from linear elastic fracture mechanics that the strength of a high speed steel is reciprocally proportional to the square root of the size of the defect. In this connection it is the largest defect in the tested volume which will determine the strength. For example the bending strength of the commercial high speed steel grade ASP-23 in the transversal direction is 3.5 $KM/mm^2$ for a bar having a round section, 1.00 mm diameter. Due to the relationship between the strength and the sizes of the defects in the structure of high grade steels, the upper limit of the carbide sizes in the steel of the invention therefore should be about 15 microns in order to achieve at least the same strength as high speed steel compositions having a comparable alloying composition known in the art.

Therefore, it is a feature of this invention that the steel contains a hard phase which essentially consists of $M_6C$ -carbides or $M_7C_3$-carbides, and that the effective maximal carbide size is between about 4 and 15 microns, the effective maximal carbide size being defined as the average size of the 30 largest carbides in the maximal extensions thereof within an area of 0.29 $cm^2$, considering that it is the largest carbides which determine the strength of the high grade steel bodies.

The high speed steel according to this invention is further characterized in that it advantageously has an alloying composition which, in percent by weight, essentially consists of 0.1 to 2 Si, 0.1 to 2 Mn, from traces to 0.5 N, 3 to 6 Cr, 0 to 13 Co, 10 to 22 (2 Mo+W), a vanadium content determined by the expression $0.1+0.05\times(2\ Mo+W)\% < \%V < 0.8+0.05\times(2\ Mo+W)\%$, and a carbon content determined by the expression $0.25+0.03\times\%(2\ Mo+W) < \%C < 0.45+0.03\times\%(2\ Mo+W)$, with the balance being iron, impurities and trace elements. The high speed steel composition is further characterized in that it contains about 5 to 16 percent by volume of hard phases, which essentially completely consist of $M_6C$-carbides. The effective maximal carbide size is from 3 to 15 microns and is preferably between about 5 and 15 microns, and more suitably between about 5 and 10 microns.

The high speed steel may optionally contain about 0.05 to 0.2 percent sulphur. Sulphur is added for steel intended for tools of large dimensions in order to improve machinability. Steel for tools of small or medium sizes, however, normally contain sulphur only as an impurity in normal amounts.

The cold work steel of the invention is characterized in that it advantageously has an alloying composition which, in percent by weight, essentially consist of 0.1 to 2 Si, 0.1 to 2 Mn, from traces to 0.5 N, 10 to 18 Cr, 0 to 5 (2 Mo+W), a vanadium content determined by the expression $-2.4+0.1\times\%(3.5\ Cr+2\ Mo+W)<\%V<-1.6+0.1\times\%(3.5\ Cr+2\ Mo+W)$, and a carbon content determined by the expression $-1.3+0.07\times\%(3.5\ Cr+2\ Mo+W)<\%C<-0.9+0.07\times\%(3.5\ Cr+2\ Mo+W)$, with the balance being iron, impurities and trace elements in normal amounts. The cold work steel further is characterized in that it contains about 10 to 40 percent by volume of carbides, essentially consisting of $M_7C_3$- carbides having an effective maximal carbide size as above described with reference to high speed steels of this invention.

Further features, aspects and advantages of the invention will be apparent from the following description of some preferred embodiments.

EXAMPLES

TABLE 1

| Steel No. | C | Si | Mn | Cr | Mo | W | Co | V | S |
|---|---|---|---|---|---|---|---|---|---|
| 1* | 1.28 | 0.5 | 0.3 | 4.2 | 5.0 | 6.4 | — | 3.1 | (a) |
| 2 | 1.15 | 0.5 | 0.5 | 4.2 | 6.5 | 6.0 | — | 2.1 | 0.1 |
| 3*** | 0.95 | 0.5 | 0.5 | 4.2 | 6.8 | 6.0 | — | 1.4 | 0.1 |
| 4** | 1.28 | 0.5 | 0.3 | 4.2 | 5.0 | 6.4 | 8.5 | 3.1 | (a) |
| 5*** | 0.95 | 0.5 | 0.5 | 4.2 | 6.8 | 6.0 | 8.5 | 1.4 | 0.1 |
| 6**** | 2.0 | 0.5 | 0.3 | 12 | 1 | — | — | 2.2 | (a) |
| 7**** | 2.7 | 0.5 | 0.3 | 15 | 1 | — | — | 3.2 | (a) |

All compositions refer to nominal composition expressed in percent by weight.
*commercially available steel (ASP 23)
**commercially available steel (ASP 30)
***examples of high speed steels of the invention
****examples of cold work steels of the invention
(a) not measured.

Metal powder of steels Nos. 1 and 3 having the nominal alloying composition according to Table 1 were produced by inert gas atomization of a metal melt in a conventional manner. The powder was poured into capsules made of steel plate. The air was drawn out and a cover was welded onto the capsules. Some of the capsules and their contents then were heated and exposed to hot isostatic compaction to full density in the usual manner at a temperature of approximately 1150° C., while other capsules and their contents were heated at 1210° C. The capsules were hot worked in a conventional manner to round bars having a diameter of 100 mm and soft annealed. Test specimens were cut out and were quenched from 1180 ° C. and tempered at 560° C. three times, one hour each time.

The structure of the steels were examined microscopically. In steel No. 1 there were found $M_6C$-carbides as well as MC-carbides, while steel No. 3 contained essentially only M6C-carbides. The carbide volumes are distributed in the following way independent of heat treatment.

TABLE 2

| Steel No. | $M_6C$ vol % | MC vol % | Total ($M_6C$ + MC) vol %, appr. |
|---|---|---|---|
| 1 | 8.5 | 5.5 | 14 |
| 3 | 14 | <0.5 | 14 |

Approximately 1% vanadium of the total amount of 1.4% vanadium in steel No. 3 was found in the matrix, and the rest, approximately 0.4% vanadium, was combined with molybdenum and tungsten in the $M_6C$-carbides. The total amount of MC-carbides could be neglected.

TABLE 3

| Steel No. | Heat treatment °C. | Effective maximal carbide size, micron(s) $M_6C$ | MC | Grindability* (min) | Resistance to bending** $KN/mm^2$ |
|---|---|---|---|---|---|
| 1 | 1150 | 3 | 1.5 | 9 | 3.5 |
| 1 | 1210 | 10 | 4.5 | 3.5 | 3.5 |
| 3*** | 1150 | 3 | 1.5 | 11 | 3.5 |
| 3**** | 1210 | 6.5 | 2 | 11 | 3.5 |

*The grindability was determined according to a method disclosed in Jernkontorets Annsler 153, 1969, pages 583–589.
**The bending test was performed as a four point bending-stress test. The material was tested in the transversal direction.
***before heat treatment in accordance with the invention
****after heat treatment in accordance with the invention As is apparent from Table 3, the grindability drops drastically for the commercial steel No. 1 when this steel has been subjected to heating at 1210° C., while the grindability of the steel No. 3 of the invention is not impaired by heating at the higher temperature.

We claim:

1. Vanadium-containing tool steel made from metal powder by compaction to full density at high pressure and high temperature, characterized in that the steel contains a hard phase, which essentially consists of $M_6C$-carbides, $M_7C_3$-carbides, or a mixture thereof and that the effective maximal size of the carbides is between 3 and 15 microns.

2. The steel of claim 1 wherein the effective maximal carbide size is from about 4 microns to about 15 microns.

3. The steel of claim 1 wherein the effective maximal carbide size is from about 5 microns to about 10 microns.

4. The steel of claims 1, 2, or 3 wherein said steel has an alloying composition of 0.1 to 2% Si, 0.1 to 2.0% Mn, trace–0.5% N, 3–6% Cr, 0–13% Co, as percent by weight, and the sum of the percent by weight of Tungsten and twice the percent by weight of Molybdenum equals from 10 to 22%, and the percent by weight of Vanadium is greater than bout $0.1+0.5\times(2\ Mo+W)$ % and is less than about $0.8+0.05\times(2\ Mo+W)$, and wherein the percent by weight of carbon is greater than about $0.25+0.03\times(2\ Mo+W)$% and less than bout $0.45+0.03\times(2\ Mo+W)$% where Mo, W and Co are the percent by weight of Molybdenum, Tungsten and Cobalt respectively and wherein the balance of said alloying composition is iron with trace impurities.

5. The steel of claim 4 wherein the percent by weight of Vanadium is at least $0.3+0.05\times(2\ Mo+W)$%—and no more than $0.6+0.5\times(2\ Mo+W)$% and wherein the percent by weight of carbon is greater than $0.29+0.03\times(2\ Mo+W)$ and is less than $0.4+0.03\times(2\ Mo+W)$.

6. The steel of claim 5 wherein the percent by weight of Vanadium is equal to $0.44+0.1+0.5\times(2\ Mo+W)$ and wherein the percent by weight of carbon is equal to $0.36\pm0.02+0.03\ (2\ Mo+W)$.

7. The steel of claim 4 wherein the sum of the percent by weight of Tungsten and twice the percent by weight of Molybdenum is from about 16% to about 20%.

8. The steel of claim 4 wherein from about 10% to about 14% of the volume of the steel comprises $M_6C$ carbides.

9. The steel of claim 4 wherein said steel contains chromium from 3 to 5% by weight, Molybdenum from 6 to 7.5% by weight and Tungsten from 5 to 7% by weight.

10. The steel of claims 1, 2 or 3 wherein said steel is a cold work steel and has an alloying composition of from 0.1 to 2% by weight Silicon, from 0.1 to 2% by weight Manganese, from a trace to 0.5% by weight Tungsten, and from 10 to 185 by weight Chromium and the sum of the percent by weight of Tungsten and twice the percent by weight of Molybdenum is from a trace to 5% and the percent by percent by weight of Vanadium is greater than $-2.4+0.1\times(3.5\ Cr+2\ Mo+W)$ and is and wherein the percent by weight of carbon is greater than $-1.3+0.07\times(3.5\ Cr+2\ Mo+W)$ and is less than $-0.9+0.07\times(3.5\ Cr+2\ Mo+W)$, where Cr, Mo and W are the percent by weight of Chromium, Molybdenum and Tungsten respectively and wherein the balance of said alloying composition is iron and trace impurities.

11. The steel of claim 10 wherein said carbides are $M_7C_3$ carbides and wherein from about 10 to 40 percent by volume of said steel comprises said carbides.

* * * * *